US006276897B1

(12) United States Patent
Tarada

(10) Patent No.: US 6,276,897 B1
(45) Date of Patent: Aug. 21, 2001

(54) COOLING IN GAS TURBINES

(75) Inventor: Fathi Tarada, Kehrsatz (CH)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/449,521

(22) Filed: Nov. 29, 1999

(30) Foreign Application Priority Data

Dec. 5, 1998 (DE) ..... 198 56 199

(51) Int. Cl.[7] ..... F01D 5/18; F01D 9/04

(52) U.S. Cl. ..... 416/97 R; 416/193 A; 416/95; 415/115; 415/116

(58) Field of Search ..... 415/115, 116; 416/95, 96 R, 96 A, 97 R, 97 A, 193 A; 60/752, 754

(56) References Cited

U.S. PATENT DOCUMENTS 4,739,621 4/1988 Pettengill et al. .

4,767,261 * 8/1988 Godfrey et al. ..... 415/115

FOREIGN PATENT DOCUMENTS 30 48 260 10/1981 (DE) .
27 18 661 8/1986 (DE) .
0 615 055 9/1994 (EP) .
59-122705 * 7/1984 (JP) ..... 416/97 R

* cited by examiner

*Primary Examiner*—Christopher Verdier
(74) *Attorney, Agent, or Firm*—Burns, Doane, Swecker & Mathis, L.L.P.

(57) ABSTRACT

The arrangements and the methods serve for the efficient and reliable cooling of components 210, in particular in turbomachines, even in the event of a local increase in the static pressure 234 of a hot fluid which flows over the component. In order to ensure sufficient cooling of the components 210, the distance between the cooling holes 240 is in each case selected in such a way that the cooling holes 240 in the region of increased static pressure 234 of the hot fluid are at a smaller distance from one another than in the regions of lower static pressure. A typical design of the invention is shown in FIG. 3.

11 Claims, 3 Drawing Sheets

COOLING IN GAS TURBINES

TECHNICAL FIELD

The invention relates to arrangements and methods for cooling components in turbomachines, in particular in gas turbines.

PRIOR ART

The efficiencies normal nowadays in turbomachines, in particular in gas turbines, require very high process temperatures. In particular in the region of the combustion chamber and the turbine inlet of the gas turbine, the temperatures are often markedly above the maximum admissible material temperatures of the components of the gas turbine. In order to avoid damage to the components as a result of excess temperature, it is therefore often necessary to cool these components. As a rule, in gas tubines, fluid, usually air, is extracted for this purpose from the compressor and fed to the components to be cooled. In this case, the fluid extracted from the compressor has a markedly lower temperature than the hot fluid flowing through the combustion chamber or the turbine. In one method of cooling components by means of a cooling fluid, so-called film cooling, the cooling fluid is blown out of cooling holes onto the component surface and thus into the flow of the hot fluid. On account of the displacement effect of the cooling fluid, a separating layer in the form of a fluid film forms between the hot fluid and the component. Consequently, the heat is no longer transferred directly from the hot fluid into the component. In this case, the separating layer is not only formed from the blown-out cooling fluid, but rather, in particular due to vortex systems, hot fluid is also admixed to and intermixed with the separating layer. This in turn leads to an increase in the average temperature of the fluid of the separating layer, as a result of which the cooling effect ultimately deteriorates.

Furthermore, in particular at component gaps, it is often conventional practice to seal off these component gaps from the hot fluid flowing over the component gap by means of a cooling fluid continuously flowing out of the component gap. In this case, the components adjacent to the component gap are cooled at the same time. In a turbomachine, component gaps occur, for example, between stationary and rotating components. Likewise, however, component gaps are also provided in order to take into account thermally induced changes in length, occurring during operation, of the components. The latter is usually the case, for example, between the combustion chamber and the turbine inlet guide wheel.

Both in the case of the film cooling described and in the case of the sealing of a component gap by means of a cooling-fluid flow flowing out of the component gap, a reliable mode of operation is only ensured with an adequate pressure difference between the cooling fluid and the hot fluid. Since, on the one hand, the cooling fluid in turbomachines is usually extracted from the compressor, but, on the other hand, only small pressure losses in the flow of the hot fluid occur in the combustion chamber, there are often only very small pressure differences between the cooling fluid and the hot fluid, in particular in the turbine inlet region. Furthermore, if an increase in the static pressure occurs locally, for example in front of the stators of the turbine inlet guide wheel, the pressure difference of the cooling fluid relative to the hot fluid is no longer sufficient in order to ensure that the component gap is completely sealed off from the hot fluid or also that a closed cooling-fluid film is formed on the surface of the component. Consequently, a local penetration of hot fluid into the component gap or into the cooling-fluid film occurs. As a result, local overheating of the adjacent components may occur. In U.S. Pat. No. 4,739,621, for the purpose of cooling the regions of the turbine inlet guide blades, special cooling-fluid feeds having elongated cross sections are arranged directly upstream of the turbine inlet guide blades. However, the design is exceptionally elaborate on account of the large number of parts and the complicated geometry.

In Patent EP 0 615 055, it is proposed to design the cooling holes upstream of the turbine inlet guide blades of a gas turbine in the regions in front of the guide blades with a larger cross section. In this case, the centers of the cooling holes are arranged at equal distances from one another. As a result of the design of the cooling holes with different cross sections, a larger cooling-fluid mass flow discharges from the cooling holes into the flow of the hot fluid in each case in the regions in front of the turbine inlet guide wheels, as a result of which a uniform cooling effect can be achieved at the periphery of the turbine inlet guide wheel. The very complicated and thus expensive production of the cooling holes having different cross sections may be mentioned as a disadvantage. In addition, the variation in the cross sections results in a deterioration in the cooling effectiveness at a cross section of the cooling holes which differs from a fluidically optimum cross section.

SUMMARY OF THE INVENTION

The object of the invention is therefore to provide an arrangement and a method in order to efficiently and reliably cool one or more components of a turbomachine even in the case of a local variation in the static pressure of the hot fluid.

This object is achieved according to the invention owing to the fact that, for the purpose of feeding a cooling fluid, cooling holes which have cross sections identical to one another and are arranged at different distances from one another are arranged in the component. In this case, the hot fluid flows over the component. A local increase in the static pressure results, for example, as a consequence of a local retention of the flow in front of the blades of the turbomachine. The arrangement of cooling holes having cross sections identical to one another can be realized in a simple and cost-effective manner from the point of view of production. In this case, the cross sections of the holes are advantageously to be selected in such a way that maximum cooling effectiveness is achieved with the lowest possible losses. Furthermore, it has been found that, by varying the distance between the cooling holes, the locally introduced cooling-fluid mass flow can be advantageously adapted to the local requirement. It has been found that very efficient and reliable cooling of the component is made possible by the arrangement according to the invention. For technical reasons related to the cooling, the smallest possible cross sections or diameters of the cooling holes are desired as a rule. In this way, the cooling effectiveness can be optimized on the one hand and, in addition, the cooling-air consumption can be limited on the other hand. Normally, however, on account of the operating conditions, a minimum cross section or diameter of the cooling holes is required, so that the cooling holes also do not become obstructed on account of dirt or particles contained in the cooling air. It has been found that a considerable advantage of the invention lies in the fact that, by the clever distribution of the cooling holes having identical cross sections and/or diameters optimized from the point of view of cooling, markedly improved cooling of the components with greater cooling effectiveness of the cooling fluid is achieved.

Of course, the design of the cooling holes with identical cross sections and/or identical diameters relates to identical cross sections and/or identical diameters of the cooling holes within the conventional manufacturing or production tolerances. Likewise, other comparable statements with regard to geometrical dimensions are always to be evaluated from the point of view of conventional manufacturing or production tolerances.

The distances between the cooling holes are advantageously selected and the cooling holes advantageously arranged in such a way that they are at smaller distances from one another in a region of increased static pressure of the fluid flow than in the region of lower static pressure of the fluid flow. Such an arrangement of the cooling holes thus results in a greater cooling-fluid mass flow in the region of increased static pressure. This leads to a thicker cooling-fluid film forming in this region on the top side of the component. It has been found that, in the event of a locally increased static pressure of the hot fluid, a thicker cooling-fluid film on the component top side is especially advantageous.

This is due to the fact that the hot fluid, at a higher static pressure, penetrates into the cooling-fluid film in an intensified manner or mixes with the latter, as a result of which the cooling effect of the cooling-fluid film is reduced. Furthermore, it has been found that vortex systems often form as a result of pressure differences, as exist in the event of a locally increased pressure. These vortex systems in turn impair the cooling effect of the cooling-fluid film, in particular in the regions of increased static pressure. As an example of such vortex formation, reference may be made here to the flow conditions during the flow around a blade, in particular in the hub or casing region. As a result of the local retention of the flow in front of the blade, a local increase in the static pressure occurs here. Vortex systems, such as, for example, the horseshoe vortex or the corner vortex, form as a result of this, in particular in the corner regions of the blade toward the hub and the casing. In this case, the distance between the cooling holes is expediently to be selected as a function of the cross sections of the cooling holes and of the cooling-fluid mass flow required in each case. The cooling-fluid mass flow in turn depends on the pressure of the hot fluid in relation to the pressure of the cooling fluid, but also on the temperatures of the hot fluid and the cooling fluid on the one hand and on the desired material temperature on the other hand.

The arrangement of the cooling bores in the component is expediently selected in such a way that the cooling holes are arranged relative to one another in a row. In a turbomachine, the cooling holes are advantageously distributed over the entire periphery of the turbomachine. On the one hand, the production cost is markedly reduced by such an arrangement in a row. On the other hand, as far as possible a continuous cooling-fluid film is thereby formed, which produces full-surface cooling of the component.

The cooling holes are advantageously designed with round or elliptical cross sections. Round or elliptical cross sections can be realized in a simple and thus cost-effective manner from the point of view of production.

The component is often expediently designed as a platform. Likewise, however, the component may also be designed as a closed circular ring or as a partial circular ring.

In the case of the design of the component as a platform, the cooling holes are advantageously arranged in the platform. In turbomachines, platforms lined up next to each other at the periphery often serve as side walls of the flow duct. The blades of the turbomachine are often arranged on such platforms. Stator blades are usually designed with platforms arranged at the blade root and at the blade tip, whereas rotor blades often only have these platforms at the blade root. In this case, the cooling holes are expediently located according to the invention upstream of the blades either on the platform connected to the blade or on a platform arranged upstream or on another component arranged upstream. In particular in the case of stator blades, a local increase, constant with respect to time, in the static pressure in front of the individual blades occurs on account of the steady flow conditions and as a result of the local stagnation-point flow. In the case of rotor blades, the location of the increased static pressure changes in accordance with the rotor revolution, so that a static pressure profile which is variable with respect to time forms in front of the blade row.

When two components are lined up next to each other, a gap often remains between these components. If a higher static pressure of the hot fluid compared with the pressure of a sealing fluid applied in the gap now forms in a region of locally increased static pressure of the flow of the hot fluid, an inflow of hot fluid into the gap may occur. According to the invention, the cooling holes are advantageously provided upstream of the gap in the component arranged upstream. In this way, the cooling-fluid film already forms upstream of the gap, so that the gap is covered by the cooling-fluid film. In addition, it is advantageous to locally intensify, for example locally thicken, the cooling-fluid film in the region of increased static pressure of the hot fluid. If a local penetration of fluid into the gap now occurs as a result of the pressure conditions, only fluid from the cooling-fluid film penetrates into the gap in the case of a cooling-fluid film intensified, for example, by local thickening. In this case, the fluid of the cooling-fluid film, as a result of the, generally slight, mixing of the intensified cooling-fluid film with the hot fluid, has a markedly lower temperature compared with the temperature of the hot fluid. Consequently, for the components adjacent to the gap, this results in markedly reduced thermal loading and, compared with an arrangement of conventional type, cooling of the components. In an expedient development of the invention, however, the cooling holes may also be arranged downstream of the gap, in which case a smaller cooling effect of the gap is then achieved depending on the blow-out direction of the cooling fluid and the distance of the cooling holes from the gap. This mainly achieves cooling of the components arranged downstream of the cooling holes.

Furthermore, the arrangement of cooling holes according to the invention may also be advantageously used for cooling combustion-chamber side walls or other heat shields, but also for cooling one or more blades.

BRIEF DESCRIPTION OF THE DRAWINGS

Exemplary embodiments of the invention are shown in the drawings. In this case, however, the invention is not only restricted to the exemplary embodiments shown but may likewise be realized in another manner in addition to the exemplary embodiments. In the drawings.

WAYS OF IMPLEMENTING THE INVENTION

Figure 1:
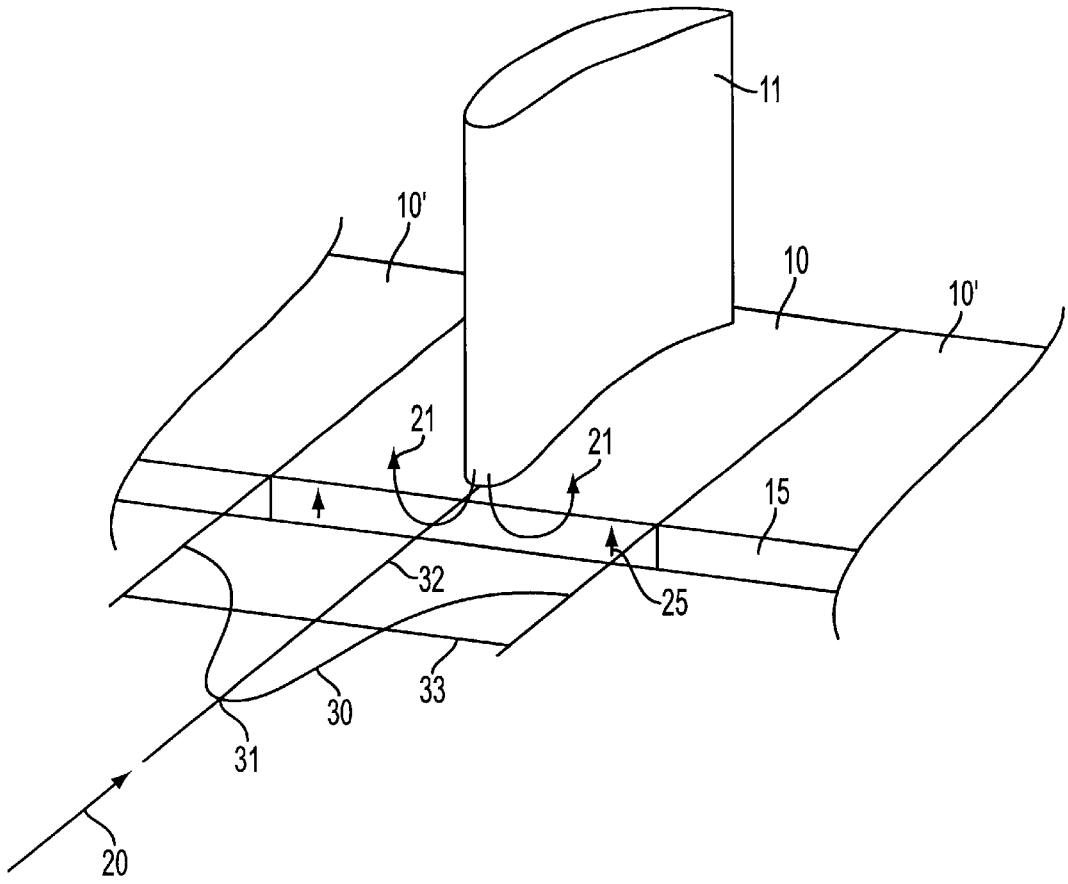
FIG. 1 shows a perspective view of a platform on which a blade is arranged, with the pressure profile forming in front of the blade.

A platform 10 having a blade 11 arranged on the platform 10 is shown in FIG. 1. Further platforms 10', which adjoin the platform 10, are indicated at the side margins of the platform 10 in the representation. The representation therefore corresponds to an arrangement of platforms as typically used at the periphery of a turbomachine. Depending on whether the platforms with the blades are arranged so as to be stationary or moved relative to the casing of the turbomachine, the representation is a detail of a stator or a rotor. The invention described here is preferably used in the hot-gas part of a turbomachine, so that the arrangement shown in FIG. 1 corresponds to a detail of a turbine of the turbomachine. In the representation, the incident flow 20 to the blade 11 is effected from the left-hand bottom corner of the figure in accordance with the direction of the arrow. Here, the incident-flow fluid is hot gas, which, for example when passing through a combustion chamber positioned upstream, has been heated to a temperature above the material temperature of the components. On account of the profile thickness of the blade 11, a displacement of the incident-flow fluid occurs. In the process, a region in which the velocity of the incident-flow fluid is reduced forms in front of the blade 11. The velocity is even reduced to zero at the stagnation point of the blade 11. As a result of the reduction in the velocity of the incident-flow fluid, a local increase in the static pressure occurs with a simultaneously virtually constant total pressure of the incident flow. As shown in FIG. 1, a profile in the distribution of the static pressure 30 therefore forms in the flow 20 of the hot fluid in front of the blade 11. The maximum 31 of the static pressure lies along the stagnation-point stream line 32. The average static pressure 33 of the incident-flow fluid in front of the blade 11 is also depicted in the representation. If a component gap 15 which is to be sealed by means of a sealing fluid 25 blown out of the component gap 15 is located in front of the platform, an inflow 21 of hot fluid into the gap may occur in the event of an inadequate pressure of the blown-out sealing fluid 25. In this case, the sealing effect of the sealing fluid 25 blown out of the gap depends directly on the local pressure conditions. In addition to the sealing effect, the sealing fluid at the same time often serves to cool the components adjacent to the flow path. Since in turbomachines the sealing fluid is usually extracted from the compressor region in order to feed it, for example, to the turbine, there is often only a very slight pressure difference between the sealing fluid and the hot fluid, in particular in the turbine inlet region directly at the outlet of the combustion chamber. In such a case, the local increase in the static pressure of the hot fluid as a result of the retention of the flow in front of the blade may result in the static pressure of the hot fluid being locally above the pressure of the sealing fluid 25, thereby causing an inflow of the hot fluid into the gap. In addition to a direct increase in the temperature of the components adjacent to the component gap, this increase in temperature resulting from the heat transfer of the hot fluid to the side walls of the gap, intensified intermixing of the boundary layers or cooling-fluid layers on the platform top side with the hot gas occurs as a result of this vortex flow. As a result, the platform downstream of the gap is also subjected to a higher temperature.

Figure 2:
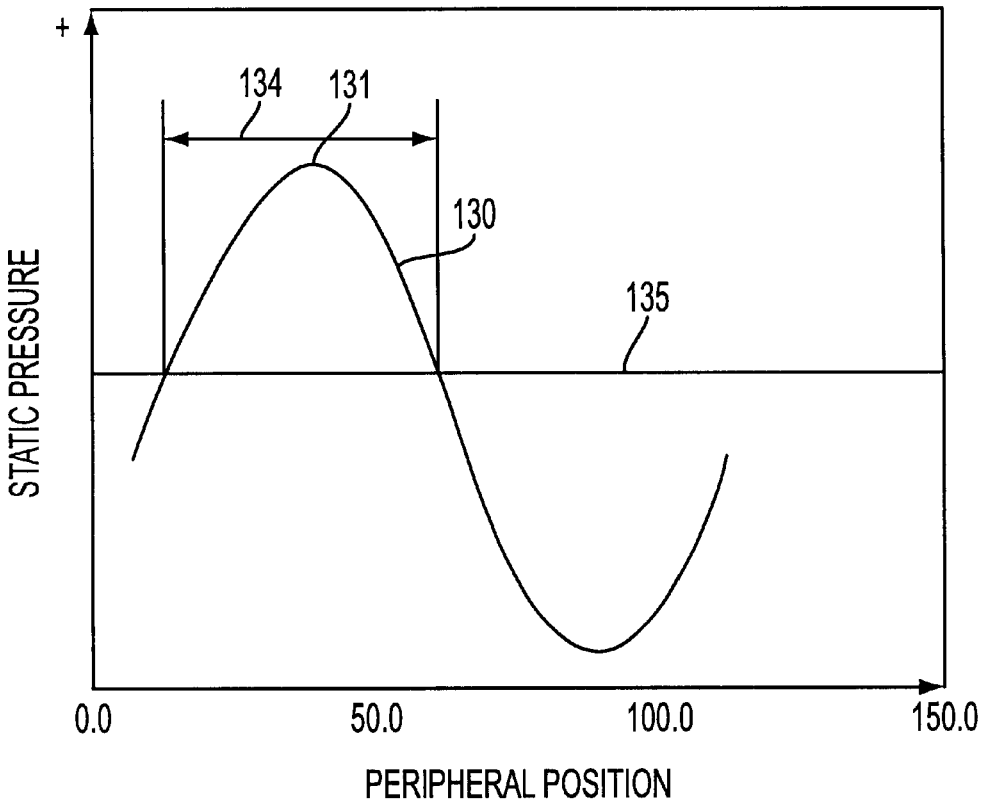
FIG. 2 shows the distribution of the static pressure in a blade pitch.

FIG. 2 shows the profile of the static pressure 130 of the hot fluid over the pitch of a blade row under consideration at the level of the front edge of the platform. In the representation shown here, the static pressure has a virtually sinusoidal profile with a maximum 131 of the static pressure, which manifests itself as a reaction of the stagnation point of the flow on the leading edge of the blade. In addition, the pressure 135 of a fluid blown out of the component gap for sealing the component gap is plotted in the representation. It can be seen from this plot that the static pressure of the hot fluid in the region around the maximum 131 in the profile of the static pressure comes to lie clearly above the pressure 135 of the fluid in the component gap, this fluid being applied in the component gap. In this region 134, therefore, there is a very high risk of the hot fluid flowing into the component gap.

Figure 3:
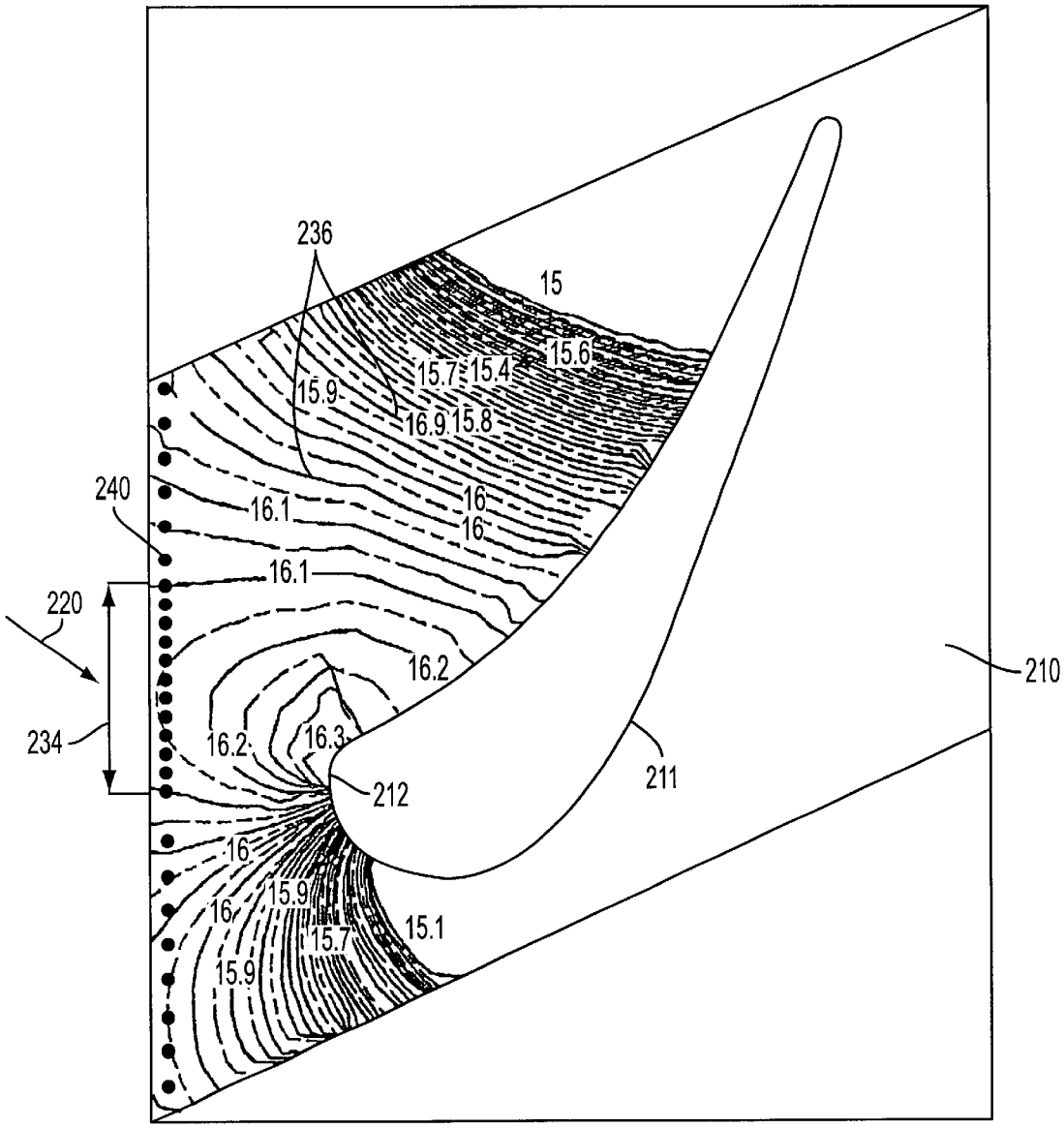
FIG. 3 shows the arrangement according to the invention of the cooling holes upstream of a blade.

In order to also ensure reliable and efficient cooling of the relevant components in the event of a local increase in the pressure of the hot fluid, cooling holes 240 have been arranged upstream of a blade 211 in FIG. 3. Here, these cooling holes 240 are each designed with a round cross section, all the cooling holes 240 having a cross-sectional area of the same size. Furthermore, in the embodiment shown, the cooling holes 240 are arranged relative to one another in a row. In a meridional section, the cooling holes as a rule are inclined at such an angle that the cooling fluid flows out of the cooling holes virtually parallel to the wall or parallel to the flow of the hot fluid. The flow 220, identified in FIG. 3 by an arrow, of the hot fluid is retained locally in front of the blade 211. This results in an increase in the static pressure in a region around the leading edge 212 of the blade 211. This increase in the static pressure becomes apparent in the isobars of the flow, which are depicted as contour lines 236. This local increase in the static pressure in the region of the leading edge 212 of the blade 211 leads to a decrease in the cooling effectiveness of a cooling-fluid film, applied for cooling the components, in the case of a conventional arrangement of the cooling holes 240. This is caused by the vortex formation already mentioned above and also a deflection flow, generally forming as a result of the pressure gradient, from the higher to the lower static pressure. This deflection flow also forms to the same extent in the cooling-fluid film. In addition to the arrangement shown in FIG. 3, a component gap between, for example, two platforms lined up next to each other in the direction of flow often occurs at a slight distance upstream of the blade. To seal such a component gap, a fluid is often applied in the component gap, and this fluid often has only a slightly higher pressure than the average static pressure of the flow of the hot fluid. Consequently, an inflow of hot fluid into the component gap may occur on account of the local increase in the static pressure of the hot fluid.

If there is a smaller distance between the cooling holes 240 in the region of higher static pressure, the cooling-fluid mass flow related to the platform surface and blown out in this region of the platform 210 increases. This results in thickening of the cooling film, acting as separating layer, between the hot fluid and the platform 210. Therefore reliable cooling of the platform 210 is ensured even in the case of intensified vortex formation or even in the case of a component gap.

| List of designations | |
|---|---|
| 10, 10', 210 | Component, platform |
| 11, 211 | Blade |
| 212 | Leading edge of the blade |
| 15 | Component gap |
| 20, 220 | Flow of the hot fluid |
| 21 | Hot fluid penetrating into the component gap |

-continued

| List of designations | |
|---|---|
| 25 | Sealing fluid |
| 30, 130 | Profile of the static pressure |
| 31, 131 | Maximum in the profile of the static pressure |
| 32 | Stagnation-point stream line |
| 33 | Average static pressure |
| 134, 234 | Region of increased static pressure |
| 135 | Pressure of a fluid in the component gap situated upstream |
| 236 | Contour lines |
| 240 | Cooling holes |

What is claimed is:

1. A component of a turbomachine comprising:

a first platform;

a hot fluid flow flowing over the first platform and having a varied static pressure in at least one region of the first platform;

a second platform, a component gap being arranged between the first platform and the second platform, the component gap positioned downstream of the first platform;

cooling holes arranged in the first platform for feeding a cooling fluid, the cooling holes having identical cross sections and being arranged at different distances from one another; and a blade arranged downstream of the cooling holes on the second platform.

2. The component as claimed in claim 1, wherein the cooling holes in a region of increased static pressure of the fluid flow are arranged at smaller distances from one another than in a region of lower static pressure of the fluid flow.

3. The component as claimed in claim 1, wherein the cooling holes are arranged in a row relative to one another.

4. The component as claimed in claim 1, wherein the turbomachine is a gas turbine.

5. The component as claimed in claim 1, wherein the cooling holes have elliptical cross sections.

6. The component as claimed in claim 5, wherein the cooling holes have round cross sections.

7. A method of cooling components of a turbomachine, comprising the steps of:

flowing a hot fluid flow over two platforms separated by a component gap, the fluid flow having an increased static pressure in at least one region;

flowing a cooling fluid for cooling at least one of the platforms, the cooling fluid covering the component gap, a greater mass flow of cooling fluid being fed in the at least one region of increased static pressure of the fluid flow than in a region of lower static pressure of the fluid flow.

8. The method as claimed in claim 7, wherein the step of flowing a cooling fluid comprises flowing the cooling fluid for forming a cooling-fluid film on a top side of a platform to a platform top side through cooling holes with identical cross sections and arranged at different distances from one another.

9. The method as claimed in claim 7, wherein the step of flowing a cooling fluid comprises flowing an intensified cooling-fluid film in the region of increased static pressure compared with the region of lower static pressure of the fluid flow.

10. The method as claimed in claim 7, wherein the step of flowing a cooling fluid comprising flowing cooling fluid with a mass flow which is locally greater in the region of increased static pressure, the cooling fluid being fed to a platform top side by smaller distances between the cooling holes in the region of increased static pressure compared with the region of lower static pressure.

11. The method as claimed in claim 7, wherein the step of flowing a cooling fluid comprising blowing the cooling fluid out onto the top side of a platform through cooling holes arranged relative to one another in a row.

* * * * *